US010367255B1

(12) United States Patent
Booen et al.

(10) Patent No.: US 10,367,255 B1
(45) Date of Patent: Jul. 30, 2019

(54) COLLIMATED TRANSVERSE ELECTRIC MODE CAVITY ANTENNA ASSEMBLY

(71) Applicant: Facebook, Inc., Menlo Park, CA (US)

(72) Inventors: Eric Booen, Thousand Oaks, CA (US); Wilhelmus Hendrikus Theunissen, Belmont, CA (US)

(73) Assignee: Facebook, Inc., Menlo Park, CA (US)

( * ) Notice: Subject to any disclaimer, the term of this patent is extended or adjusted under 35 U.S.C. 154(b) by 0 days.

(21) Appl. No.: 15/887,431

(22) Filed: Feb. 2, 2018

(51) Int. Cl.

| | |
|---|---|
| ***H01Q 1/28*** | (2006.01) |
| ***H01Q 15/16*** | (2006.01) |
| ***H01Q 21/06*** | (2006.01) |
| ***H01Q 1/12*** | (2006.01) |
| ***H01Q 3/08*** | (2006.01) |

(52) U.S. Cl.
CPC ..... *H01Q 1/288* (2013.01); *H01Q 1/125* (2013.01); *H01Q 3/08* (2013.01); *H01Q 15/16* (2013.01); *H01Q 21/065* (2013.01)

(58) Field of Classification Search
CPC ..... H01Q 1/288; H01Q 1/125; H01Q 3/08; H01Q 15/16; H01Q 21/065
See application file for complete search history.

(56) References Cited

U.S. PATENT DOCUMENTS

| | | | | |
|---|---|---|---|---|
| 4,047,181 | A | 9/1977 | Hoople | |
| 4,054,876 | A | 10/1977 | Hoople | |
| 4,131,893 | A * | 12/1978 | Munson | H01Q 1/27 343/700 MS |
| 6,812,893 | B2 | 11/2004 | Waterman | |
| 7,019,705 | B2 | 3/2006 | Pfletschinger | |
| 7,068,235 | B2 | 6/2006 | Guidon | |
| 8,362,965 | B2 | 1/2013 | Henderson | |
| 8,797,227 | B2 | 8/2014 | Owens | |
| 9,413,051 | B2 | 8/2016 | Milroy | |
| 9,413,073 | B2 | 8/2016 | Milroy | |
| 9,653,801 | B2 | 5/2017 | Milroy | |
| 2008/0117113 | A1 * | 5/2008 | Haziza | H01Q 1/32 343/786 |

OTHER PUBLICATIONS

"Hybrid Method of Analysis for Aperture-Coupled Patch Antenna Array for MIMO Systems," Ndujiuba, Charles et al., Int'l Journal of Electromagnetics and Applications 2015, pp. 90-97.

* cited by examiner

*Primary Examiner* — Hoang V Nguyen
(74) *Attorney, Agent, or Firm* — FisherBroyles, LLP

(57) ABSTRACT

The disclosed apparatus may include (1) an antenna assembly defining an upper cavity with an aperture, the antenna assembly further defining a lower cavity coupled to the upper cavity via a channel along a linear edge of the antenna assembly, where the antenna assembly may include a reflective element within the lower cavity having a concave parabolic contour, and (2) an array assembly positioned in the aperture and including an array of passive elements. The reflective element may transform a divergent radio frequency (RF) beam directed toward the concave parabolic contour within the lower cavity into a collimated RF beam propagating within the lower cavity and into the upper cavity via the channel, and the array of passive elements may radiate a transmitted RF beam from the aperture in response to the collimated RF beam in the upper cavity. Various other apparatuses, methods, and systems are also disclosed.

20 Claims, 10 Drawing Sheets

COLLIMATED TRANSVERSE ELECTRIC MODE CAVITY ANTENNA ASSEMBLY

BACKGROUND

Internet access is often viewed as an important aspect of modern life. While in years past users were limited to accessing the Internet via various landline-based connections, users across the globe now frequently access the Internet via a variety of mobile connections, including via WIFI routers located in homes and businesses or via smartphones connected to cellphone towers.

While cellphone tower accessibility continues to progress across population centers, significant gaps in coverage, particularly in rural areas, remain. To address these gaps, some providers have attempted to bridge satellite communication systems (such as those used on some commercial airliners) with local area networks (e.g., WIFI and Ethernet) in order to provide Internet access to users in rural areas. However, such communication systems (particularly mobile satellite communications (SATCOM) systems, low earth orbit (LEO) and medium earth orbit (MEO) satellite constellations, and others) are often prohibitively expensive for most users and, thus, not typically practical. Consequently, as LEO constellations become realizable, development of low-cost antennas capable of tracking such orbits may provide rural and mobile users potential relief from the cost of traditional SATCOM while maintaining, and in some cases enabling, Internet connectivity.

SUMMARY

As will be described in greater detail below, the instant disclosure describes a collimated transverse electric mode cavity antenna assembly. For example, an apparatus may include (1) an antenna assembly defining an upper cavity with an aperture, the antenna assembly further defining a lower cavity coupled to the upper cavity via a channel along a linear edge of the antenna assembly, where the antenna assembly may include a reflective element within the lower cavity having a concave parabolic contour, and (2) an array assembly positioned in the aperture and including an array of passive elements. In such an example, the reflective element may transform a divergent radio frequency (RF) beam directed toward the concave parabolic contour within the lower cavity into a collimated RF beam propagating within the lower cavity and into the upper cavity via the channel, and the array of passive elements may radiate a transmitted RF beam from the aperture in response to the collimated RF beam in the upper cavity.

In some embodiments, the antenna assembly may also include (1) a baseplate having an upper surface, (2) a cover plate having an upper surface and a lower surface, the cover plate being connected to the baseplate so that the upper surface of the baseplate and the lower surface of the cover plate at least partially define the lower cavity, where an edge of the baseplate and an edge of the cover plate at least partially define a lower linear orifice of the lower cavity at the linear edge of the antenna assembly, (3) an upper plate having a lower surface and defining the aperture, where the lower surface of the upper plate, the array assembly, and the upper surface of the cover plate at least partially define the upper cavity, where the edge of the cover plate and an edge of the upper plate at least partially define an upper linear orifice of the upper cavity at the linear edge of the antenna assembly, and (4) an cavity transfer element that couples the lower cavity to the upper cavity at the lower linear orifice and the upper linear orifice, where the cavity transfer element at least partially defines the channel. In some examples, at least one of the baseplate, the cover plate, the upper plate, the cavity transfer element, or the reflective element may include a conductive material. In some other embodiments, at least one of the baseplate, the cover plate, the upper plate, the cavity transfer element, or the reflective element includes plastic may at least partially covered with a conductive material. In some examples, the conductive material may include aluminum.

In some embodiments, the apparatus may also include a transmitter that emits the divergent RF beam within the lower cavity toward the concave parabolic contour.

In some examples, an orientation of the array of passive elements about a central axis defined by the aperture relative to the antenna assembly may determine an elevation angle of the transmitted RF beam relative to the array assembly. Moreover, in some embodiments, the apparatus may also include (1) a bearing assembly that rotatably couples the array assembly to the antenna assembly, and (2) a drive mechanism that rotates the array assembly about the central axis relative to the antenna assembly to alter the elevation angle of the transmitted RF beam relative to the array assembly. In some examples, the drive mechanism may include a worm gear to rotate the array assembly.

In some embodiments, an orientation of the antenna assembly about a central axis defined by the aperture relative to a platform may determine an azimuth angle of the transmitted RF beam relative to the platform. Further, in some examples, the apparatus may also include (1) a bearing assembly that rotatably couples the antenna assembly to the platform, and (2) a drive mechanism that rotates the antenna assembly about the central axis relative to the platform to alter the azimuth angle of the transmitted RF beam relative to the platform. In various embodiments, the drive mechanism may include a worm gear to rotate the antenna assembly. Also, in some examples, the drive mechanism may be mounted on the antenna assembly.

In some examples, the array of passive elements may include one of an array of aperture-coupled radiators or an array of direct-coupled radiators, or may include a patch antenna array. In some embodiments, the divergent RF beam and the collimated RF beam may include transverse electric (TE) mode waves.

In some embodiments, the array of passive elements may generate a second collimated RF beam in the upper cavity directed toward the channel in response to receiving an external RF beam via the aperture, the channel may redirect the second collimated RF beam from the upper cavity to the lower cavity toward the concave parabolic contour, and the concave parabolic contour may generate, from the second collimated beam, a convergent RF beam directed toward a receiver within the lower cavity.

In one example, a system may include (1) an antenna assembly defining an upper cavity with an aperture, the antenna assembly further defining a lower cavity coupled to the upper cavity via a channel along a linear edge of the antenna assembly, where the antenna assembly may include a reflective element within the lower cavity having a concave parabolic contour, (2) an array assembly positioned in the aperture and comprising an array of passive elements, (3) a transmitter that emits a divergent radio frequency (RF) beam within the lower cavity toward the concave parabolic contour, where the concave parabolic contour may transform the divergent RF beam into a collimated RF beam propagating within the lower cavity and into the upper cavity via the channel, and where the array of passive elements may radiate a transmitted RF beam from the aperture in response to the collimated RF beam in the upper cavity, (4) a first drive mechanism that rotates the array assembly about a central axis defined by the aperture relative to the antenna assembly to alter an elevation angle of the transmitted RF beam relative to the array assembly, and (5) a control system that operates the first drive mechanism to control the elevation angle of the transmitted RF beam relative to the array assembly. In some embodiments, the system may also include a second drive mechanism that rotates the antenna assembly about the central axis to alter an azimuth angle of the transmitted RF beam relative to a platform, where the control system may operate the second drive mechanism to control the azimuth angle of the transmitted RF beam relative to the platform.

In one example, a method may include (1) receiving, at a concave parabolic contour of a reflective element located within a lower cavity of an antenna assembly, a divergent RF beam, (2) transforming, using the concave parabolic contour, the divergent RF beam into a collimated RF beam for propagation within the lower cavity toward a channel defined along a linear edge of the antenna assembly, (3) redirecting, using the channel, the collimated RF beam into an upper cavity of the antenna assembly, and (4) radiating, using an array of passive elements positioned in an aperture of the upper cavity, a transmitted RF beam from the aperture in response to the collimated RF beam in the upper cavity of the antenna assembly.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
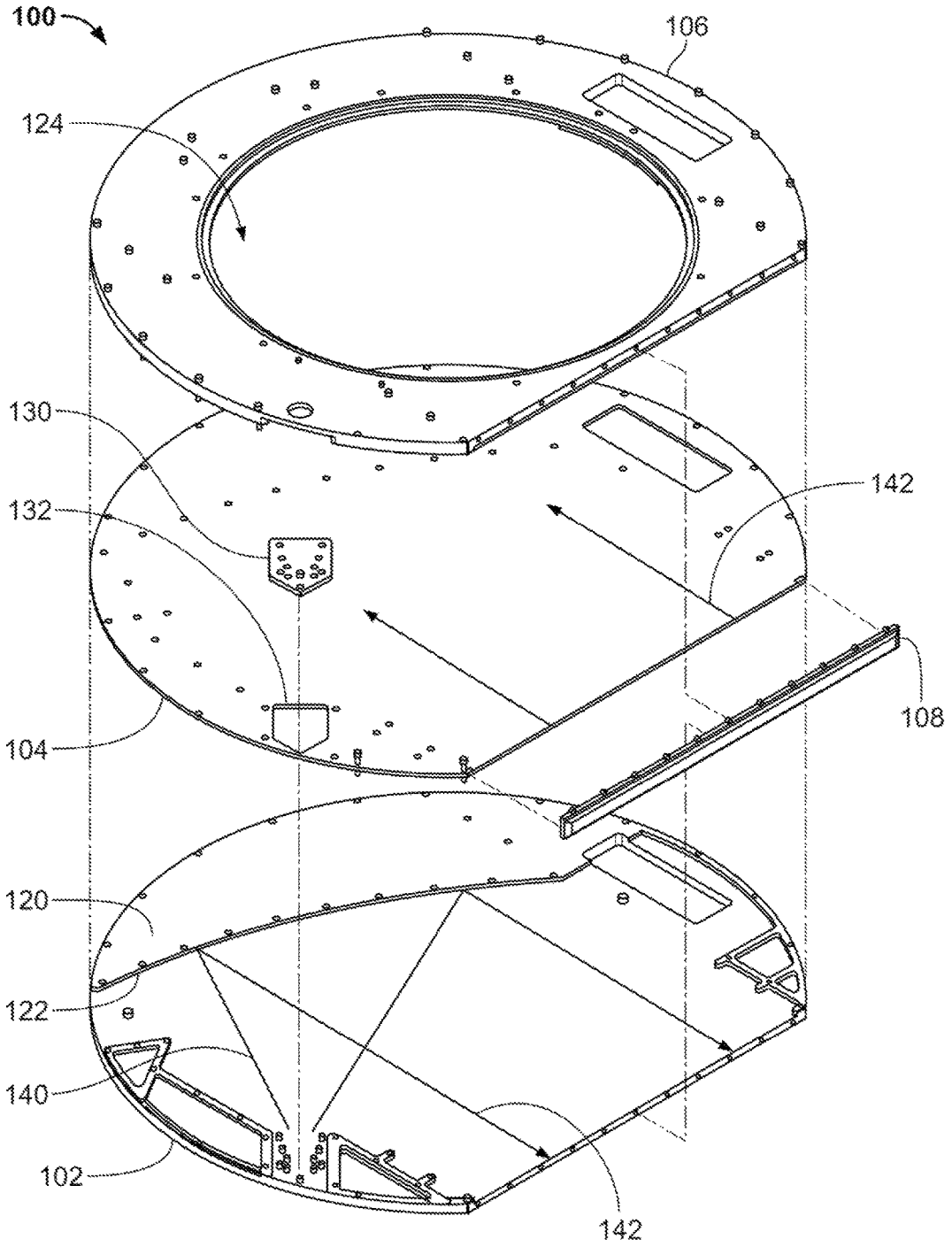
FIG. 1 is an exploded perspective view of an exemplary antenna assembly and corresponding transmitter.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The present disclosure is generally directed to a dual-cavity antenna assembly with an internal parabolic reflective element. As will be explained in greater detail below, embodiments of the instant disclosure may facilitate a low-profile antenna amenable for use in mobile applications, such as for installation on an external surface of a vehicle. Moreover, use of the parabolic reflective element may inexpensively facilitate collimation of a divergent transmission beam (e.g., from a feedhorn or other RF transmitter) over a wide frequency range.

Figure 2:
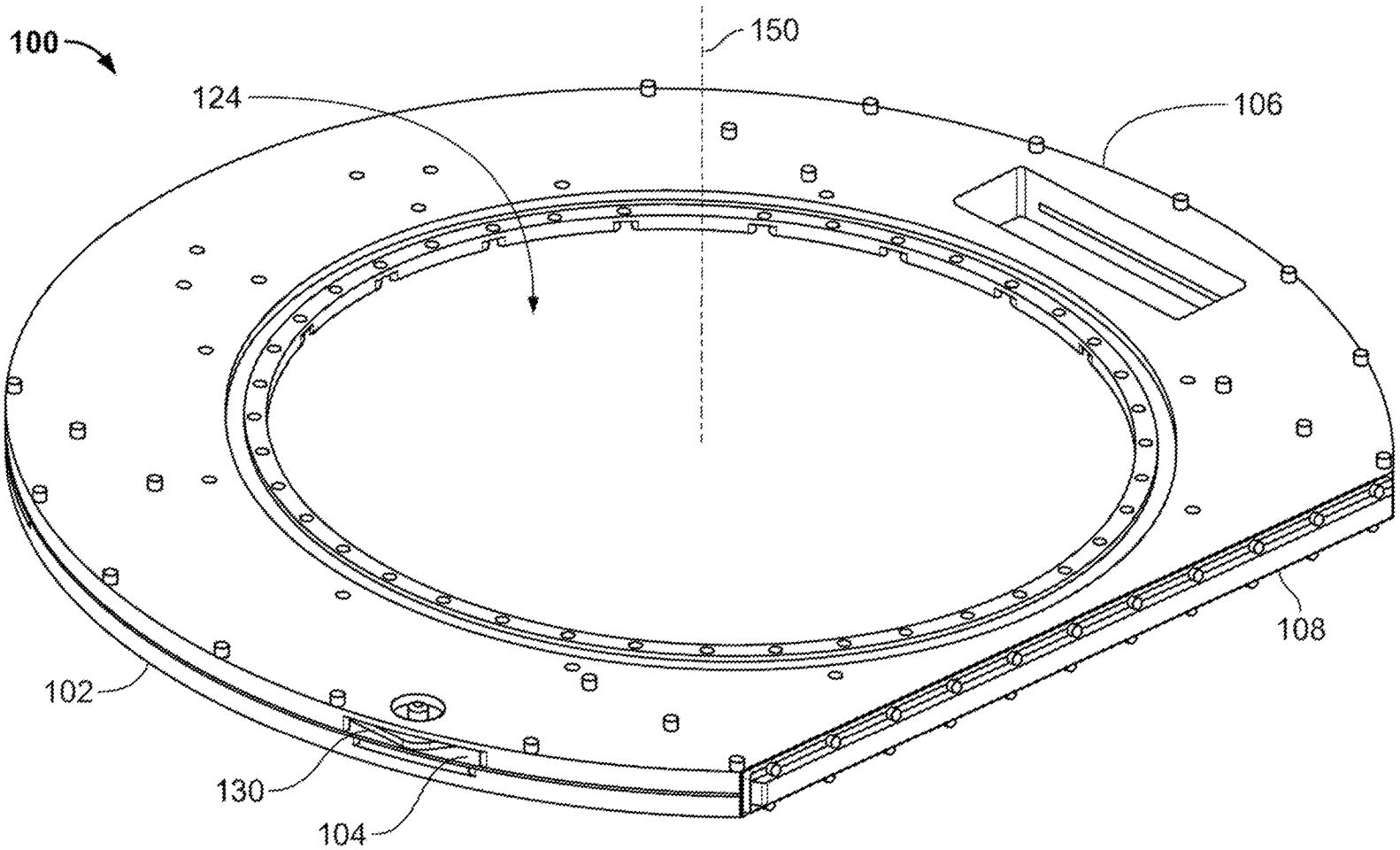
FIG. 2 is an assembly perspective view of the exemplary antenna assembly of FIG. 1.
Figure 3:
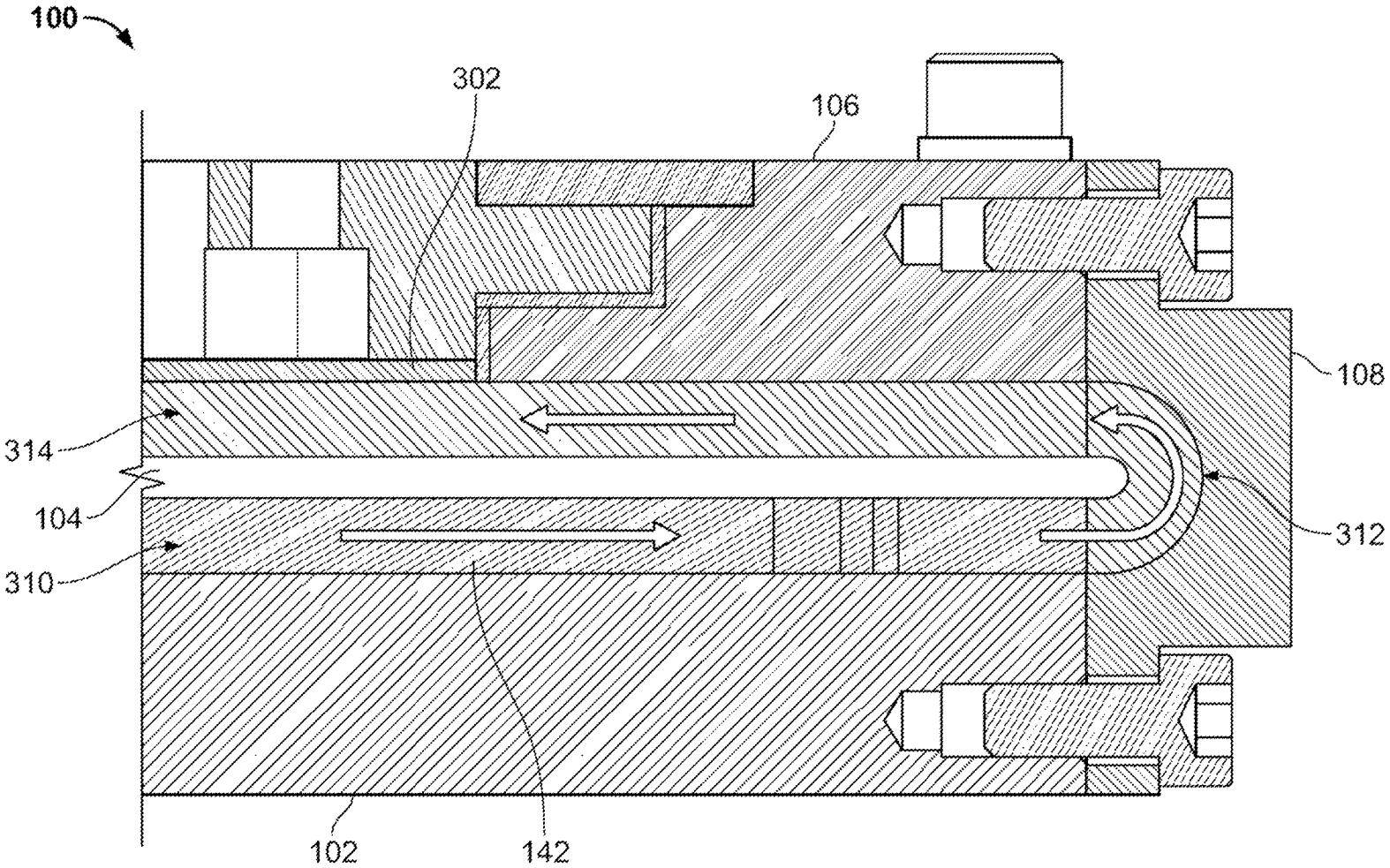
FIG. 3 is a partial cross-sectional view of the exemplary antenna assembly of FIG. 1, including an array assembly.
Figure 4:
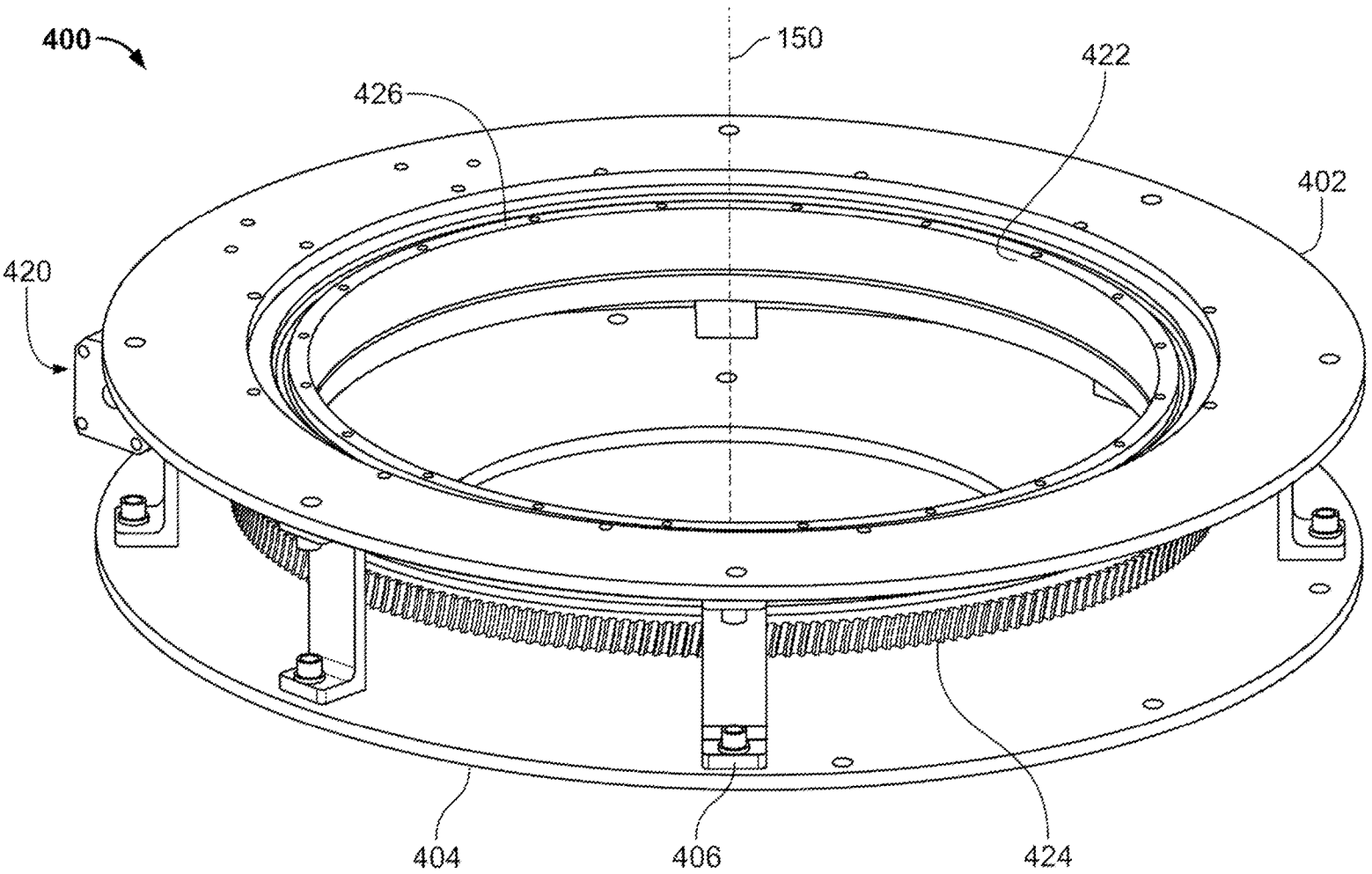
FIG. 4 is an assembly perspective view of an exemplary platform interface assembly for use with the exemplary antenna assembly of FIG. 1.
Figure 5:
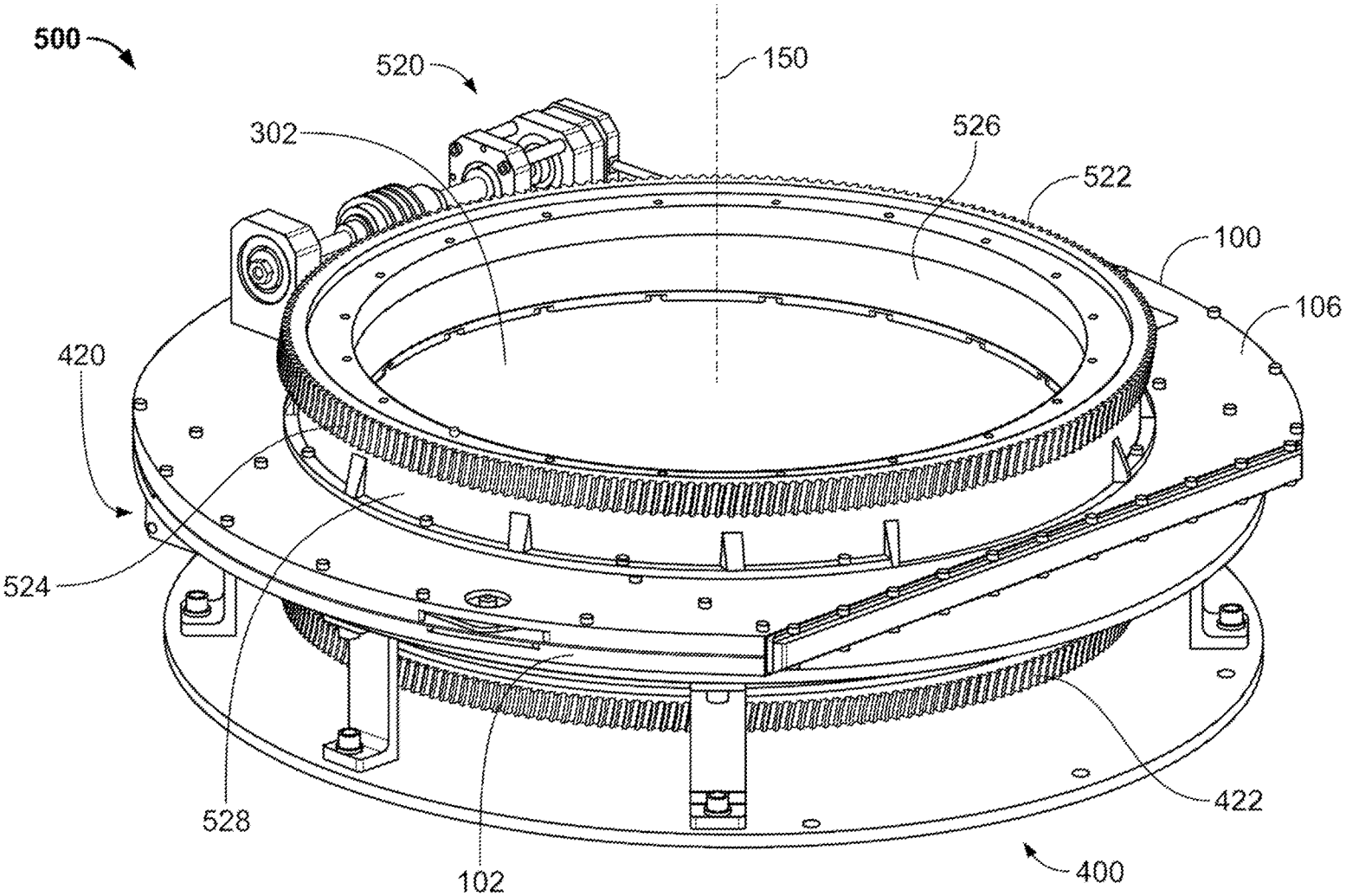
FIG. 5 is an assembly perspective view of an exemplary antenna including the exemplary array assembly of FIG. 1 and the exemplary platform interface assembly of FIG. 4.
Figure 6:
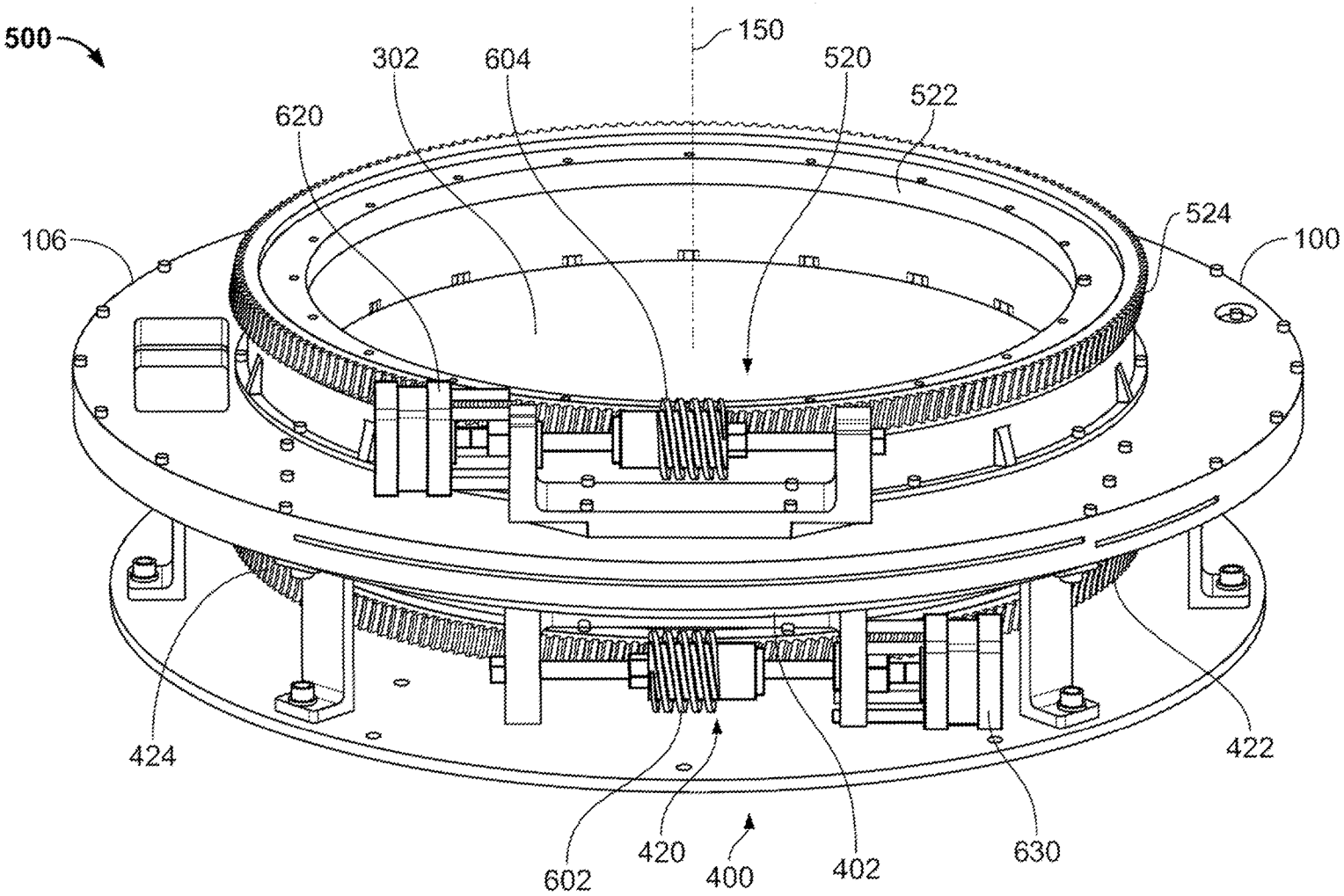
FIG. 6 is another assembly perspective view of the exemplary antenna of FIG. 5 showing upper and lower drive assemblies.

The following will provide, with reference to FIGS. 1-10, detailed descriptions of apparatuses, systems, and methods involving a dual-cavity antenna assembly using an internal parabolic reflective element. Descriptions of an exemplary antenna assembly with a reflective element are provided below in conjunction with FIGS. 1-3. Descriptions of an exemplary platform interface assembly that may couple the antenna assembly of FIGS. 1-3 with a platform are provided in connection with FIG. 4. An exemplary antenna including the antenna assembly of FIGS. 1-3 and the platform interface assembly of FIG. 4 is discussed below in conjunction with FIGS. 5 and 6. A description of an exemplary array assembly that may be employed with the antenna of FIGS. 5 and 6 is provided in connection with FIG. 7. In relation to FIGS. 8 and 9, a discussion of exemplary methods of transmission and reception using the antenna of FIGS. 5 and 6 is presented. The following also provides, with reference to FIG. 10, a discussion of an exemplary system employing the antenna of FIGS. 5 and 6.

In the following detailed description, references are made to various directions or orientations (e.g., upper, lower, vertical, horizontal, and the like). These references are provided for convenience in describing various aspects of the embodiments and examples presented below, and are not intended to limit the orientation of exemplary antenna assemblies and other components discussed herein. While the various embodiments of the exemplary antenna assemblies are presented in a substantially horizontal orientation (e.g., with a central axis aligned vertically), other orientations of the various embodiments (e.g., vertical, inverted, and so on) are also possible.

FIG. 1 is an exploded perspective view of an exemplary antenna assembly 100 with a reflective element 120 that has a concave parabolic contour 122. As shown in FIG. 1, antenna assembly 100 may include several components, including a baseplate 102, a cover plate 104, an upper plate 106, and a cavity transfer element 108. Additionally, reflective element 120, in some examples, such as that depicted in FIG. 1, is integrated in baseplate 102. However, other embodiments of antenna assembly 100 may include greater or fewer numbers of components and/or may be organized or structured differently from that specifically shown in FIG. 1. For example, in some embodiments, reflective element 120 may be integrated in cover plate 104, implemented as a component separate from baseplate 102 and cover plate 104, or embodied in some other manner. In some examples, one or more of baseplate 102, cover plate 104, upper plate 106, cavity transfer element 108, or reflective element 120 may be made of a conductive metallic material (e.g., aluminum). In other embodiments, one or more of baseplate 102, cover plate 104, upper plate 106, cavity transfer element 108, or reflective element 120 may be made of a non-metallic material (e.g., plastic or other dielectric) covered at least partially with a conductive material, such as aluminum. Other materials may be employed for one or more of components 102, 104, 106, 108, or 120.

As indicated via dashed lines in FIG. 1, cover plate 104 may be attached atop baseplate 102, and upper plate 106 may be attached atop cover plate 104 such that a linear edge of each component 102, 104, and 106 is aligned with each other. Such attachment may be performed using bolts, screws, and/or other attachment means. As a result of these attachments, an upper surface of baseplate 102 and a lower surface of cover plate 104 may at least partially define a lower cavity, and the linear edge of baseplate 102 and the linear edge of cover plate 104 may at least partially define a lower linear orifice for the lower cavity. Also in some examples, an upper surface of cover plate 104 and a lower surface of upper plate 106 may at least partially define an upper cavity, and the linear edge of cover plate 104 and the linear edge of upper plate 106 may at least partially define an upper linear orifice for the upper cavity.

Cavity transfer element 108 may be coupled along the linear edges of baseplate 102, cover plate 104, and upper plate 106, such as by way of bolts, screws, and/or the like. Further, cavity transfer element 108 may at least partially define a channel (e.g., a channel having a semi-cylindrical shape oriented along the linear edges of baseplate 102, cover plate 104, and upper plate 106) that couples the lower cavity (e.g., at the lower linear orifice) with the upper cavity (e.g., at the upper linear orifice) when cavity transfer element 108 is coupled to at least baseplate 102 and upper plate 106.

Also illustrated in FIG. 1 is a transmitter 130 (e.g., a feedhorn or an E-plane feedpoint) that may transmit a divergent RF beam within the lower cavity toward concave parabolic contour 122 of reflective element 120. In some examples, transmitter 130 may transmit a transverse electric (TE) mode beam in which the electric field of the transmitted beam may be aligned vertically (e.g., transverse to the direction of propagation in the lower cavity and/or the upper cavity). As shown in FIG. 1, transmitter 130 may at least partially protrude through an access opening of cover plate 104 in some embodiments while attached to baseplate 102. In other examples, transmitter 130 may be connected to cover plate 104.

As denoted by way of arrows in FIG. 1, transmitter 130 may transmit a divergent beam 140 toward concave parabolic contour 122 of reflective element 120. In the particular example of FIG. 1, transmitter 130 is located at or near a rounded edge of baseplate 102 substantially across baseplate 102 from concave parabolic contour 122 such that divergent beam 140 is received by concave parabolic contour 122. Due to the angle at which divergent beam 140 encounters concave parabolic contour 122 in conjunction with the curvature of concave parabolic contour 122, concave parabolic contour 122 may reflect divergent beam 140 as a collimated beam 142 toward cavity transfer element 108. More generally, in some embodiments, transmitter 130 may be located with respect to baseplate 102 such that the origin of divergent RF beam 140 is located at a focal point of concave parabolic contour 122 so that collimated beam 142 is directed toward cavity transfer element 108. Moreover, in some examples, collimated beam 142 may travel perpendicularly to cavity transfer element 108 (e.g., perpendicularly to the linear edges of baseplate 102 and cover plate 104 and enter the channel defined by cavity transfer element 108 so that collimated beam 142 is redirected across the upper cavity that is at least partially defined by cover plate 104 and upper plate 106. In some embodiments, collimated beam 142 propagates in the upper cavity in a direction 180 degrees opposite that in which collimated beam 142 travels in the lower cavity.

As a result of using concave parabolic contour 122 of reflective element 120, antenna assembly 100, in at least some embodiments, may provide a low-loss RF transmission (and possibly reception) option in a small form factor. In other embodiments, reflective element 120 instead may be constructed of a dielectric material (e.g., a dielectric lens) that is sized and shaped (e.g., possibly having a shape not incorporating a concave parabolic contour) to form a lensing mechanism for redirecting and collimating a divergent RF beam, as described above.

Upper plate 106 may include an aperture 124 in which an array assembly (not explicitly shown in FIG. 2) is positioned. As is discussed in greater detail below, collimated beam 142 in the upper cavity may interact with such an array assembly to radiate a transmitted RF beam from aperture 124.

FIG. 2 is an assembly perspective view of antenna assembly 100, in which baseplate 102, cover plate 104, upper plate 106, and cavity transfer element 108 are assembled together, along with transmitter 130, as described above. FIG. 2 also depicts aperture 124, which in some examples may be circular in shape and may define a central axis 150 about which the array assembly (not shown in FIG. 2) may be rotated relative to antenna assembly 100. In some embodiments, central axis 150 may also be located at a geometric center of, and may be oriented normal to, a circle defined by at least a portion of a perimeter of baseplate 102, cover plate 104, and/or upper plate 106.

FIG. 3 is a partial cross-sectional view of antenna assembly 100 of FIGS. 1 and 2, along with an array assembly 302, such as that mentioned above. In some examples, a lower cavity 310 formed by baseplate 102 and cover plate 104 may carry collimated beam 142 toward (e.g., perpendicularly) and into a channel 312 defined by cavity transfer element 108. Channel 312 may then redirect collimated beam 142 (e.g., by 180 degrees) into an upper cavity 314 so that it may interact with array assembly 302. In some examples, the surfaces defining lower cavity 310, channel 312, and upper cavity 314 (e.g., as provided by various surfaces of baseplate 102, cover plate 104, upper plate 106, cavity transfer element 108, and/or array assembly 302) may be continuous to reduce potential unwanted reflections of collimated beam 142.

FIG. 4 is a perspective view of an exemplary platform interface assembly 400 that may be used to couple an antenna assembly (e.g., antenna assembly 100 of FIG. 1) to another surface or object, referenced herein as a platform. In some embodiments, the platform may be an external or internal area of a building or other structure, an interior or exterior of a vehicle, or some other surface or object. As shown in FIG. 4, platform interface assembly 400 may include an interface plate 402 that is connected to a platform plate 404 by way of one or more standoffs 406. In some examples, standoffs 406 may be screwed, bolted, or otherwise affixed to interface plate 402 and platform plate 404. In turn, platform plate 404 may be affixed to the platform (e.g., a structure or surface as large or larger than platform plate 404). In other examples, standoffs 406 may be attached directly to the platform.

As also shown in FIG. 4, a lower bearing assembly 422 may be rotatably coupled to interface plate 402, such as by way of a bearing structure. More specifically, in some embodiments, an inner portion 426 of lower bearing assembly 422 may be attached to, or be continuous with, a ring gear 424, such that inner portion 426 may rotate (e.g., about central axis 150) relative to an outer portion of lower bearing assembly 422 that may be affixed to interface plate 402. Moreover, in some embodiments, ring gear 424 may be driven by a lower drive assembly 420 (partially shown in FIG. 4). In some examples, lower drive assembly 420 may include a worm gear or other type of gear driven by an electrical motor (e.g., a stepper motor) to precisely rotate ring gear 424 and associated inner portion 426 of lower bearing assembly 422. In some embodiments described below, interface plate 402 may define a central opening through which an antenna assembly (e.g., antenna assembly 100 of FIGS. 1 and 2) may be attached to inner portion 426 of lower bearing assembly 422 so that lower assembly drive 420 may precisely rotate antenna assembly 100 about central axis 150 relative to interface plate 402 and other portions of platform interface assembly 400.

FIG. 5 is an assembly perspective view of an exemplary antenna 500 that may include antenna assembly 102, array assembly 302, and platform interface assembly 400, along with an upper bearing assembly 522 and an upper drive assembly 520. As discussed above, antenna assembly 100 (e.g., via baseplate 102) may be affixed to inner portion 426 (not viewable in FIG. 5) of lower bearing assembly 422 such that lower drive assembly 420 may rotate antenna assembly 100 (e.g., about central axis 150) relative to platform interface assembly 400. Moreover, in some examples, array assembly 302 may be affixed to an inner portion 526 of upper bearing assembly 522 that may be rotated (e.g., about central axis 150) relative to an outer portion 528 of upper bearing assembly 522 that may be affixed to antenna assembly 100 (e.g., at upper plate 106). Additionally, in some embodiments, inner portion 526 of upper bearing assembly 522 may be attached to, or continuous with, a ring gear 524 that may be driven by upper drive assembly 520 such that inner portion 526 and attached array assembly 302 may be rotated relative to antenna assembly 100. In some examples, upper drive assembly 520 may include an electric motor (e.g., a stepper motor) that may rotate a gear (e.g., a worm gear) that may interact with ring gear 524 to rotate array assembly 302.

FIG. 6 is an assembly perspective view of antenna 500 that more clearly shows lower drive assembly 420 and upper drive assembly 520. In some examples, lower drive assembly 420 may be mounted or otherwise fixably attached to platform interface assembly 400 (e.g., at a lower surface of interface plate 402), while upper drive assembly 520 may be mounted or otherwise fixably attached to antenna assembly 100 (e.g., at an upper surface of upper plate 106). As described above, in some examples, lower drive assembly 420 may include lower drive motor 630 (e.g., a stepper motor) that may rotate a worm gear 602 engaged with ring gear 424 to rotate antenna assembly 100 relative to platform interface assembly 400 (and thus the platform) via lower bearing assembly 422. Similar, upper drive assembly 520 may include upper drive motor 620 (e.g., a stepper motor) that may rotate a worm gear 604 engaged with ring gear 524 to rotate array assembly 302 relative to antenna assembly 100 via upper bearing assembly 522.

In some examples, use of upper drive assembly 520 and lower drive assembly 420 to rotate portions of antenna 500, as described above, may facilitate steering of an RF transmission beam from array assembly 302 over a range of azimuth angles (e.g., about central axis 150) and elevation angles (e.g., between horizontal and vertical orientations). More specifically, in some embodiments, operation of lower drive motor 630 may cause rotation of antenna assembly 100 relative to platform interface assembly 400 (and, thus, the platform to which platform interface assembly 400 is attached) by way of lower bearing assembly 422 horizontally about central axis 150. This rotational motion may cause the transmitted beam from array assembly 302 to be rotated horizontally about central axis 150 (e.g., through a full 360 degrees). Also in some examples, operation of upper drive motor 620 may cause rotation of array assembly 302 relative to antenna assembly 100 by way of upper bearing assembly 522. This type of rotation may cause the angle of orientation of array assembly 302 relative to collimated beam 142 in upper cavity 314 to change by the same amount. As is described in greater detail below, this change in angle between array assembly 302 and collimated beam 142 may alter the orientation of the transmitted RF beam from array assembly 302 in the vertical direction (e.g., between a first angle above horizontal to a second angle substantially vertical, or parallel to central axis 150). Consequently, in some examples, by operation of lower drive assembly 420 and upper drive assembly 520, the transmitted RF beam from array assembly 302 may be directed continuously from some angle above horizontal to substantially vertical, and at any horizontal angle about central axis 150.

In some examples, either or both lower drive assembly 420 and upper drive assembly 520 may incorporate various types of motor or drive technologies, including, but not limited to, stepper motors, brushless direct current (DC) motors, piezoelectric drives, and harmonic drives. While the use of stepper motors and other types of drive assemblies may facilitate open loop control, optical encoders and/or other position sensing components may be used in some examples to determine a current relative position of portions of antenna 500 to facilitate closed loop feedback. The choice of various control options may depend, in some examples, on the particular frequencies being transmitted or received, the particular application in which antenna 500 is used, and/or other factors. Additionally, while embodiments described herein employ worm gears and/or ring gears in conjunction with lower drive assembly 420 and upper drive assembly 520, other types of gearing or coupling, including, but not limited to, spur gears and helical gears, may be utilized in other embodiments.

Figure 7:
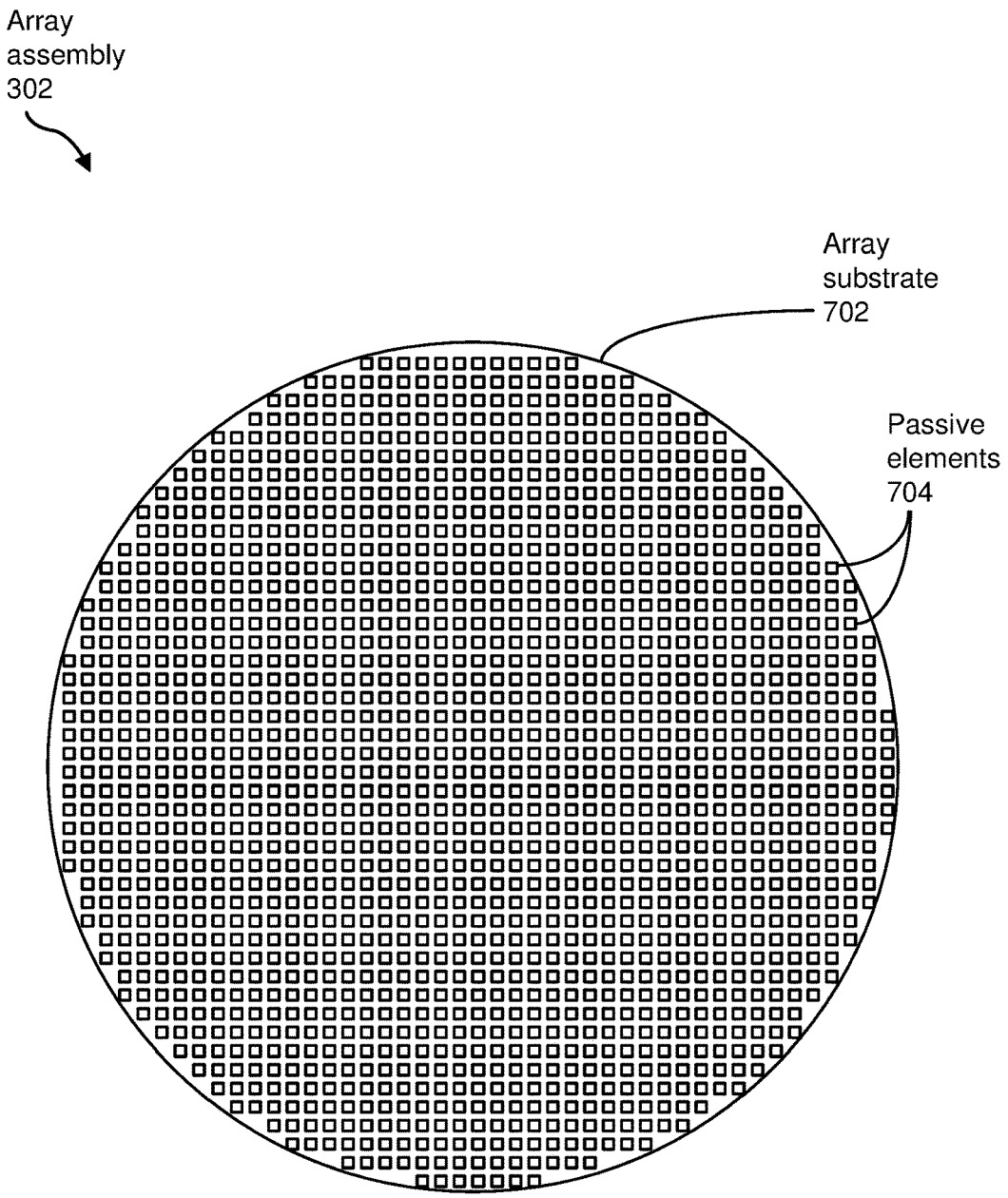
FIG. 7 is a plan view of an exemplary array assembly for use in the exemplary antenna of FIG. 6.

FIG. 7 is a plan view of an exemplary array assembly (e.g., array assembly 302 of FIGS. 3, 5, and 6) for use with antenna 500. As shown in FIG. 7, array assembly 302 may include an array substrate 702 (e.g., a printed circuit board) of substantially non-RF-reflective material, such as a dielectric. In some embodiments, array substrate 702 may be circular so that it may be located within aperture 124 of upper plate 106 of antenna assembly 100, with a center that is intersected by, and normal to, central axis 150 when installed in aperture 124.

An array of passive elements 704 may be located (e.g., printed) on array substrate 702 in a pattern such that, as a group, passive elements 704 may be substantially aligned in a plane and may transmit an RF beam in response to collimated beam 142 in upper cavity 314. As depicted in FIG. 7, passive elements 704 may be aligned in a grid of rows and columns, although other configurations are also possible. In some examples, passive elements 704 may include aperture-coupled (e.g., slot-coupled) RF radiators, direct-coupled RF radiators individual RF patch antennas, or the like. In some embodiments, passive elements 704 are coupled passive elements in that they may be parasitically coupled to a driving element (e.g., transmitter 130).

In at least some examples, a relative alignment of the rows or columns of passive elements 704 with collimated beam 142 in upper cavity 314 may determine an elevation angle of the resulting transmitted beam, as determined by the relative timing of the RF transmissions of individual passive elements 704 (or groups of passive elements 704) in response to collimated beam 142. In some embodiments, the transmitted RF beam may be substantially perpendicular to array assembly 302 (e.g., vertical, or aligned with central axis 150) when the rows or columns of passive elements 704 are aligned with collimated beam 142 in upper cavity 314. In other examples, the transmitted RF beam may be inclined (e.g., relative to central axis 150) toward horizontal when the rows or columns of passive elements 704 are at an angle (e.g., an acute angle) relative to collimated beam 142 in upper cavity 314. In these embodiments, the amount of inclination of the transmitted RF beam may be related to the magnitude of the angle between the rows or columns of passive elements 704 and the collimated beam 142 in upper cavity 314. Consequently, by altering this angle (e.g., using upper drive assembly 520), the elevation angle of the transmitted RF beam may be controlled.

Figure 8:
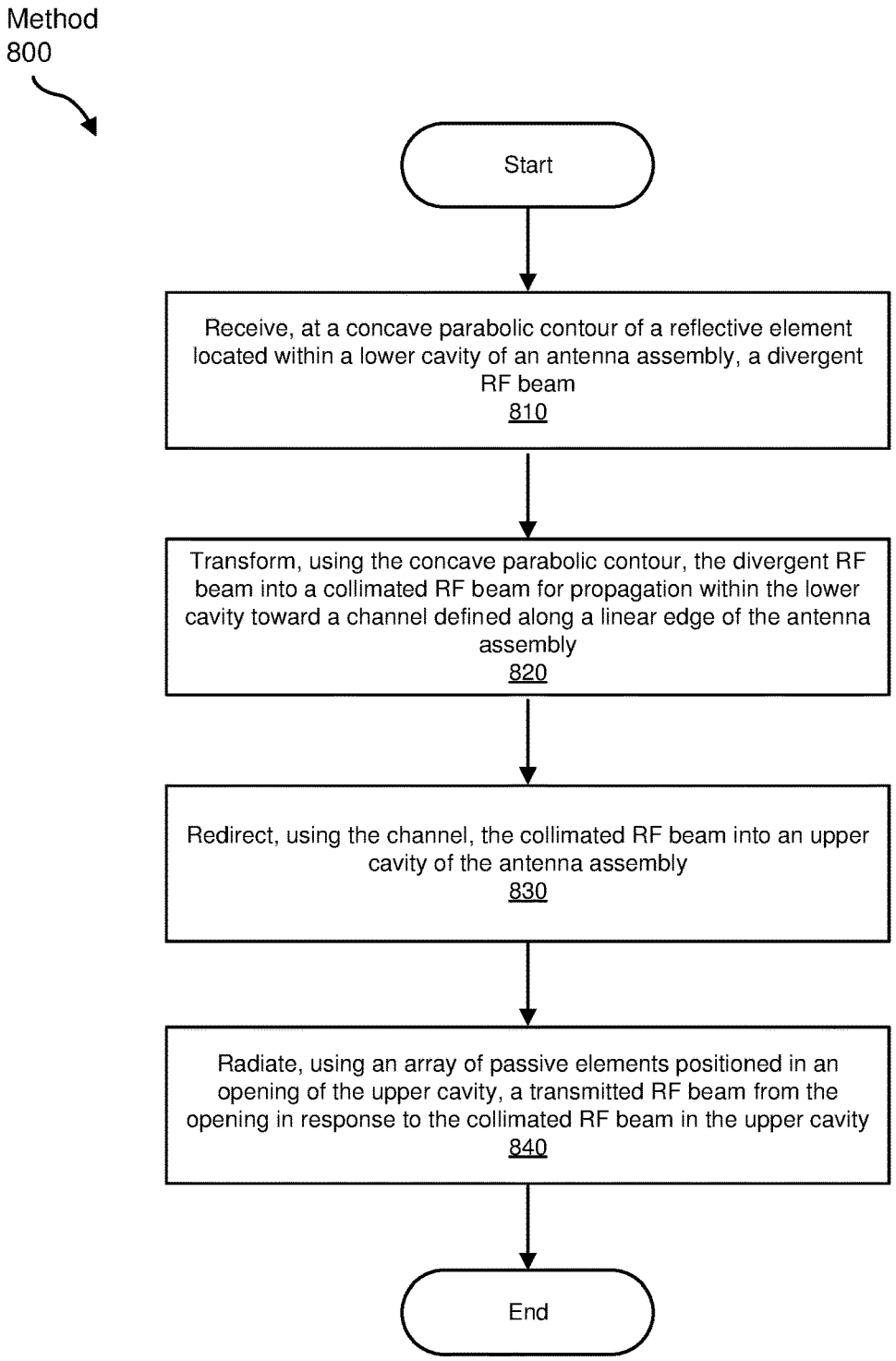
FIG. 8 is a flow diagram of an exemplary method of transmission using a dual-cavity antenna assembly with an internal parabolic reflective element.

FIG. 8 is a flow diagram of an exemplary method 800 of transmission using a dual-cavity antenna assembly (e.g., antenna assembly 100 of FIGS. 1-3) with an internal parabolic reflective element (e.g., reflective element 120 of FIG. 1). In the method 800, at step 810, a divergent RF beam (e.g., divergent beam 140 of FIG. 1) may be received at a concave parabolic contour (e.g., concave parabolic contour 122 of FIG. 1) of the reflective element located within a lower cavity (e.g., lower cavity 310 of FIG. 3) of the antenna assembly. At step 820, using the concave parabolic contour, the divergent RF beam may be transformed into a collimated RF beam (e.g., collimated beam 142 of FIG. 1) for propagation within the lower cavity toward a channel (e.g., channel 312 of FIG. 3) defined along a linear edge of the antenna assembly. At step 830, using the channel, the collimated RF beam may be redirected into an upper cavity (e.g., upper cavity 314 of FIG. 3) of the antenna assembly. At step 840, an array of passive elements (e.g., passive elements 740 of FIG. 7) positioned at an aperture (e.g., aperture 124 of FIGS. 1 and 2) of the antenna assembly may radiate a transmitted RF beam from the aperture in response to the collimated RF beam in the upper cavity. Moreover, in some examples, the transmitted RF beam may be steered in both the vertical (e.g., elevation) and horizontal (e.g., azimuth) directions, such as by use of lower drive assembly 420 and upper drive assembly 520, as discussed above.

Figure 9:
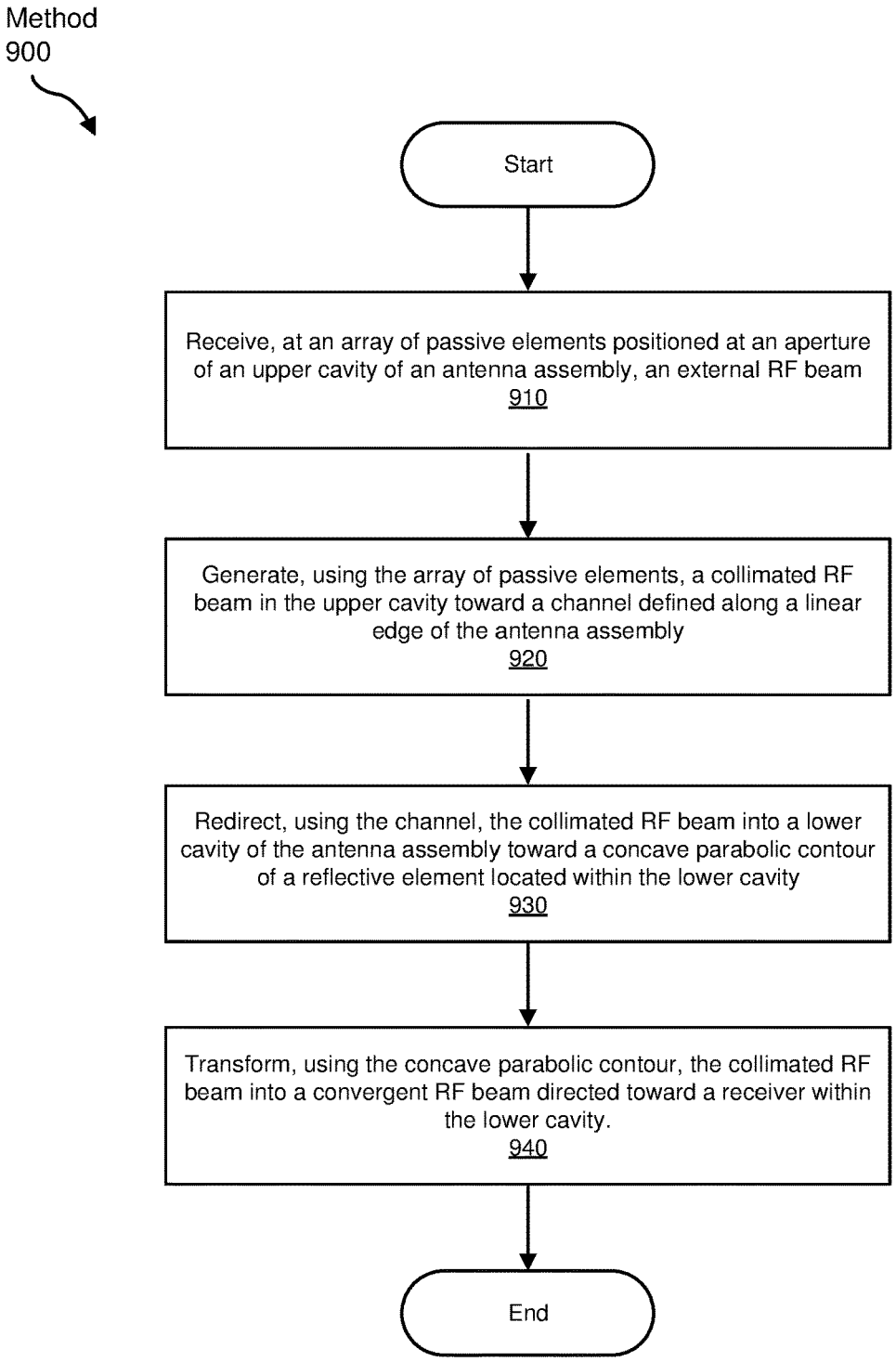
FIG. 9 is a flow diagram of an exemplary method of reception using a dual-cavity antenna assembly with an internal parabolic reflective element.

In other example methods, an external RF beam transmitted by another antenna system may be received using an antenna assembly similar to embodiments of antenna assembly 100 discussed herein. For example, RF transmitter 130 of FIGS. 1 and 2 may be replaced or supplemented with an RF receiver that may receive a convergent RF beam. Accordingly, FIG. 9 is a flow diagram of an exemplary method 900 of reception using a dual-cavity antenna assembly (e.g., antenna assembly 100 of FIGS. 1-3) with an internal parabolic reflective element (e.g., reflective element 120 of FIG. 1). In the method 900, at step 910, an array of passive elements (e.g., passive elements 740 of FIG. 7) positioned at an aperture (e.g., aperture 124 of FIGS. 1 and 2) of the antenna assembly may receive the external RF beam. At step 920, the array of passive elements may generate a collimated RF beam in the upper cavity (e.g., upper cavity 314 of FIG. 3) toward a channel (e.g., channel 312 of FIG. 3) along a linear edge of the antenna assembly. At step 930, the collimated RF beam may then be redirected by the channel into a lower cavity (e.g., lower cavity 310 of FIG. 3) of the antenna assembly toward a parabolic concave contour (e.g., concave parabolic contour 122 of FIG. 1) of the reflective element (e.g., reflective element 120 of FIG. 1). At step 940, the concave parabolic contour may then transform the collimated RF beam into the convergent RF beam directed toward the RF receiver. In some example methods, separate transmission and reception antennas may be employed to provide RF transmission and reception capabilities in a single communication system. In some examples, RF transmitter 130 and the RF receiver may be the same RF component. Also, in some embodiments, the RF transmission and reception may occur in a half-duplex or full-duplex mode. In yet other embodiments, additional RF transmission and/or receiving components (e.g., feedhorns), as well as multiple parabolic contours and other elements, may be employed within antenna 500 to facilitate multiple separated frequency bands that may involve varying feed geometries.

Figure 10:
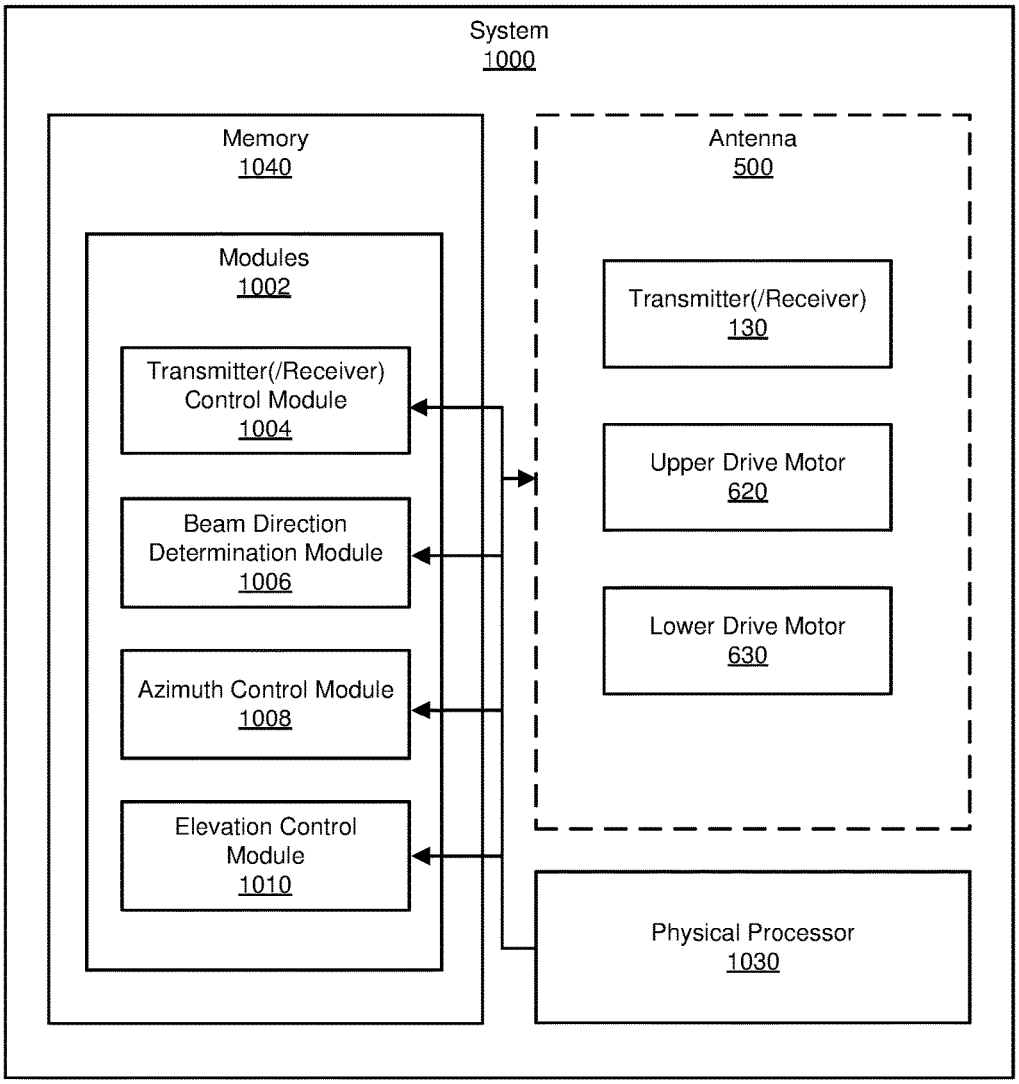
FIG. 10 is a block diagram of an exemplary system including a dual-cavity antenna assembly with an internal parabolic reflective element.

FIG. 10 is a block diagram of an exemplary system 1000 including a dual-cavity antenna assembly (e.g., antenna assembly 100 of FIGS. 1-3) with an internal parabolic reflective element (e.g., reflective element 120 of FIG. 1), as discussed above. As illustrated in FIG. 10, example system 1000 may include one or more modules 1002 for performing one or more tasks. As will be explained in greater detail below, modules 1002 may include a transmitter (and/or receiver) control module 1004, a beam direction determination module 1006, an azimuth control module 1008, and an elevation control module 1010. Although illustrated as separate elements, one or more of modules 1002 in FIG. 10 may represent portions of a single module or application.

In the example embodiments described in greater detail below, system 1000 may be employed as at least a portion of a communication device that employs one or more antennas (e.g., antenna 500 of FIGS. 5 and 6) for communicating wirelessly with other RF communication devices, such as communication satellites.

Transmitter control module 1004 may generate a communication data stream from which an RF signal is generated and forwarded to transmitter 130 (FIG. 1) for transmission as an RF beam by antenna 500, as described above in connection with FIG. 8. Generation of the communication data, in some examples, may also include converting data into a data stream according to one or more communication protocols, generation of metadata for inclusion in the data stream, and the like. In some embodiments, transmitter control module 1004 may additionally or alternatively serve as a receiver control module by which data is received and subsequently processed from a receiver of one or more antennas 500, as described above in conjunction with FIG. 9.

Beam directional determination module 1006 may determine a particular direction relative to a current orientation of antenna 500 to which a transmitted RF beam is to be directed, and/or from which a received RF beam is expected.

Such information may be based from location and orientation information of antenna 500 (e.g., using Global Positioning System (GPS) information), location information of other communication devices (e.g., communication satellites), and so on. Based on the determined direction, azimuth control module 1008 and elevation control module 1010 may generate signals to operate upper drive motor 620 (of upper drive assembly 520) and/or lower drive motor 630 (of lower drive assembly 420) to orient array assembly 302 relative to antenna assembly 100, and to orient antenna assembly 100 relative to a platform to which antenna 500 is attached, to transmit an RF beam to (and/or receive an RF beam from) another RF communication device, as discussed above.

In certain embodiments, one or more of modules 1002 in FIG. 10 may represent one or more software applications or programs that, when executed by a computing device, may cause the computing device to perform one or more tasks. One or more of modules 1002 in FIG. 10 may also represent all or portions of one or more special-purpose computers configured to perform one or more tasks.

As illustrated in FIG. 10, example system 1000 may also include one or more memory devices, such as memory 1040. Memory 1040 generally represents any type or form of volatile or non-volatile storage device or medium capable of storing data and/or computer-readable instructions. In one example, memory 1040 may store, load, and/or maintain one or more of modules 1002. As illustrated in FIG. 10, example system 1000 may also include one or more physical processors, such as physical processor 1030, that may access and/or modify one or more of modules 1002 stored in memory 1040. Additionally or alternatively, physical processor 1030 may execute one or more of modules 1002. In yet other example embodiments, one or more of modules 1002, or portions thereof, instead may be implemented as hardware components not stored in memory 1040, such as electronic circuitry for performing one or more tasks described above.

As explained above in conjunction with FIGS. 1 through 10, the antenna assemblies described herein, as well as the systems and methods employing such assemblies, may facilitate low-profile antenna systems that are appropriate for mobile applications, as well for other environments. Moreover, such antenna systems may be provided at a relatively low cost while enabling high-bandwidth RF communications, thus potentially allowing personal- or family-level Internet access at a high level of performance.

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. An apparatus comprising:

an antenna assembly defining an upper cavity with an aperture, the antenna assembly further defining a lower cavity coupled to the upper cavity via a channel along a linear edge of the antenna assembly, wherein the antenna assembly comprises a reflective element within the lower cavity having a concave parabolic contour; and an array assembly positioned in the aperture and comprising an array of passive elements;

wherein the reflective element transforms a divergent radio frequency (RF) beam directed toward the concave parabolic contour within the lower cavity into a collimated RF beam propagating within the lower cavity and into the upper cavity via the channel; and wherein the array of passive elements radiates a transmitted RF beam from the aperture in response to the collimated RF beam in the upper cavity.

2. The apparatus of claim 1, wherein the antenna assembly further comprises:

a baseplate having an upper surface;

a cover plate having an upper surface and a lower surface, the cover plate being connected to the baseplate so that the upper surface of the baseplate and the lower surface of the cover plate at least partially define the lower cavity, wherein an edge of the baseplate and an edge of the cover plate at least partially define a lower linear orifice of the lower cavity at the linear edge of the antenna assembly;

an upper plate having a lower surface and defining the aperture, wherein the lower surface of the upper plate, the array assembly, and the upper surface of the cover plate at least partially define the upper cavity, wherein the edge of the cover plate and an edge of the upper plate at least partially define an upper linear orifice of the upper cavity at the linear edge of the antenna assembly; and an cavity transfer element that couples the lower cavity to the upper cavity at the lower linear orifice and the upper linear orifice, wherein the cavity transfer element at least partially defines the channel.

3. The apparatus of claim 2, wherein at least one of the baseplate, the cover plate, the upper plate, the cavity transfer element, or the reflective element comprises a conductive material.

4. The apparatus of claim 2, wherein at least one of the baseplate, the cover plate, the upper plate, the cavity transfer element, or the reflective element comprises plastic at least partially covered with a conductive material.

5. The apparatus of claim 4, wherein the conductive material comprises aluminum.

6. The apparatus of claim 1, further comprising a transmitter that emits the divergent RF beam within the lower cavity toward the concave parabolic contour.

7. The apparatus of claim 1, wherein an orientation of the array of passive elements about a central axis defined by the aperture relative to the antenna assembly determines an elevation angle of the transmitted RF beam relative to the array assembly.

8. The apparatus of claim 7, further comprising:

a bearing assembly that rotatably couples the array assembly to the antenna assembly; and a drive mechanism that rotates the array assembly about the central axis relative to the antenna assembly to alter the elevation angle of the transmitted RF beam relative to the array assembly.

9. The apparatus of claim 8, wherein the drive mechanism comprises a worm gear to rotate the array assembly.

10. The apparatus of claim 1, wherein an orientation of the antenna assembly about a central axis defined by the aperture relative to a platform determines an azimuth angle of the transmitted RF beam relative to the platform.

11. The apparatus of claim 10, further comprising:

a bearing assembly that rotatably couples the antenna assembly to the platform; and a drive mechanism that rotates the antenna assembly about the central axis relative to the platform to alter the azimuth angle of the transmitted RF beam relative to the platform.

12. The apparatus of claim 11, wherein the drive mechanism comprises a worm gear to rotate the antenna assembly.

13. The apparatus of claim 11, wherein the drive mechanism is mounted on the antenna assembly.

14. The apparatus of claim 1, wherein the array of passive elements comprises one of an array of aperture-coupled radiators or an array of direct-coupled radiators.

15. The apparatus of claim 1, wherein the array of passive elements comprises a patch antenna array.

16. The apparatus of claim 1, wherein at least one of the divergent RF beam or the collimated RF beam comprises transverse electric (TE) mode waves.

17. The apparatus of claim 1, wherein the array of passive elements generates a second collimated RF beam in the upper cavity directed toward the channel in response to receiving an external RF beam via the aperture, wherein the channel redirects the second collimated RF beam from the upper cavity to the lower cavity toward the concave parabolic contour, and wherein the concave parabolic contour generates, from the second collimated RF beam, a convergent RF beam directed toward a receiver within the lower cavity.

18. A system comprising:

an antenna assembly defining an upper cavity with an aperture, the antenna assembly further defining a lower cavity coupled to the upper cavity via a channel along a linear edge of the antenna assembly, wherein the antenna assembly comprises a reflective element within the lower cavity having a concave parabolic contour;

an array assembly positioned in the aperture and comprising an array of passive elements;

a transmitter that emits a divergent radio frequency (RF) beam within the lower cavity toward the concave parabolic contour, wherein the concave parabolic contour transforms the divergent RF beam into a collimated RF beam propagating within the lower cavity and into the upper cavity via the channel, and wherein the array of passive elements radiates a transmitted RF beam from the aperture in response to the collimated RF beam in the upper cavity;

a first drive mechanism that rotates the array assembly about a central axis defined by the aperture relative to the antenna assembly to alter an elevation angle of the transmitted RF beam relative to the array assembly; and a control system that operates the first drive mechanism to control the elevation angle of the transmitted RF beam relative to the array assembly.

19. The system of claim 18, further comprising a second drive mechanism that rotates the antenna assembly about the central axis to alter an azimuth angle of the transmitted RF beam relative to a platform, wherein the control system operates the second drive mechanism to control the azimuth angle of the transmitted RF beam relative to the platform.

20. A method comprising:

receiving, at a concave parabolic contour of a reflective element located within a lower cavity of an antenna assembly, a divergent RF beam;

transforming, using the concave parabolic contour, the divergent RF beam into a collimated RF beam for propagation within the lower cavity toward a channel defined along a linear edge of the antenna assembly;

redirecting, using the channel, the collimated RF beam into an upper cavity of the antenna assembly; and radiating, using an array of passive elements positioned in an aperture of the upper cavity, a transmitted RF beam from the aperture in response to the collimated RF beam in the upper cavity of the antenna assembly.

* * * * *